US005306185A

United States Patent [19]

Lassanske et al.

[11] Patent Number: 5,306,185

[45] Date of Patent: Apr. 26, 1994

[54] CATALYTIC ELEMENTS FOR MARINE PROPULSION DEVICE

[75] Inventors: George G. Lassanske, Nashotah, Wis.; Edgar Rose, Glencoe, Ill.; Theodore J. Holtermann, Brookfield, Wis.

[73] Assignee: Outboard Marine Corporation, Waukegan, Ill.

[21] Appl. No.: 20,905

[22] Filed: Feb. 22, 1993

Related U.S. Application Data

[63] Continuation of Ser. No. 822,972, Jan. 21, 1992, abandoned.

[51] Int. Cl.[5] ..... F01N 3/28

[52] U.S. Cl. ..... 440/89; 60/296

[58] Field of Search ..... 440/89; 60/295, 296, 60/299, 302; 55/DIG. 30; 422/177, 178

[56] References Cited

U.S. PATENT DOCUMENTS

| | | | |
|---|---|---|---|
| 3,149,926 | 9/1964 | Johnson | 23/288 |
| 3,189,417 | 6/1965 | Houdry et al. | 23/288 |
| 3,607,133 | 9/1971 | Hirao et al. | 55/DIG. 30 |
| 3,644,098 | 2/1972 | De Palma et al. | 23/288 |
| 3,853,483 | 12/1974 | Cross, Jr. | 23/288 |
| 3,957,445 | 5/1976 | Foster | 23/288 |
| 4,167,852 | 9/1979 | Ludecke | 60/296 |
| 4,235,846 | 11/1980 | Abthoff et al. | 422/171 |
| 4,248,833 | 2/1981 | Aoyama | 60/299 |
| 4,261,170 | 4/1981 | Suzuki | 60/302 |
| 4,386,497 | 6/1983 | Takagi et al. | 60/296 |
| 4,404,798 | 9/1983 | Takagi et al. | 60/296 |
| 4,485,622 | 12/1984 | Takagi et al. | 60/296 |
| 4,495,153 | 1/1985 | Midorikawa | 422/171 |
| 4,735,046 | 4/1988 | Iwai | 60/295 |
| 4,843,815 | 7/1989 | Smojver | 60/299 |

*Primary Examiner*—Sherman Basinger
*Attorney, Agent, or Firm*—Michael, Best & Friedrich

[57] ABSTRACT

A marine propulsion device comprising a propulsion unit including a propeller shaft, a housing including an exhaust gas inlet and an exhaust gas outlet, a catalytic element supported in the housing for reorientation from a first orientation to a second orientation different from the first orientation, and structure for reorienting the element from the first orientation to the second orientation.

20 Claims, 2 Drawing Sheets

CATALYTIC ELEMENTS FOR MARINE PROPULSION DEVICE

RELATED APPLICATION

This application is a continuation of application Ser. No. 07/822,972 filed Jan. 21, 1992 and now abandoned.

BACKGROUND OF THE INVENTION

The invention relates generally to marine propulsion devices such as outboard motors and stern drive units. More particularly, the invention relates to catalytic elements in exhaust gas passageways in marine propulsion devices.

SUMMARY OF THE INVENTION

The invention provides a marine propulsion device comprising a propulsion unit including a propeller shaft, a housing including an exhaust gas inlet and an exhaust gas outlet, a catalytic element housed in the housing for reorientation from a first orientation to a second orientation different from the first orientation, and means for reorienting the element from the first orientation to the second orientation.

One embodiment of the invention provides a marine propulsion device comprising a propulsion unit including a propeller shaft, and a housing defining an exhaust gas passageway, the exhaust gas passageway having therein a shoulder, the marine propulsion device further comprising a catalytic element, including a rib, in the exhaust gas passageway, and a retaining sleeve which is mounted in the housing and which partially surrounds the element such that the rib is captured between the shoulder and the retaining sleeve.

One embodiment of the invention provides a method of maintaining a catalytic element in an engine apparatus including a housing defining an exhaust gas passageway, the method comprising the steps of providing the element in a first orientation in the exhaust gas passageway, and reorienting the element from the first orientation to a second orientation different from the first orientation.

One embodiment of the invention provides a method of maintaining a catalytic element in a marine propulsion device comprising a propulsion unit including an exhaust gas passageway and a propeller shaft, the method comprising the steps of providing the element in a first orientation in the exhaust gas passageway, and reorienting the element from the first orientation to a second orientation different from the first orientation.

The inventors of the present invention have found that in marine propulsion devices comprising an internal combustion engine, an exhaust passageway having an exhaust gas inlet and an exhaust gas outlet, and a catalytic element (catalyst) in the exhaust passageway, deposits accumulate on a side of the catalytic element facing the exhaust gas inlet. These deposits are from impurities in fuel and oil combusted by the internal combustion engine (some marine propulsion devices include two stroke engines which require a fuel including mixing oil mixed with gasoline), engine wear particles, salt from sea water ingested by the engine, and the like. In addition to these deposits, when the engine is operated with a light load, a layer of carbonaceous material can build up on the side of the catalytic element facing the exhaust gas inlet. Some of this carbonaceous material remains even after subsequent operation of the engine at higher loads.

The inventors of the present invention have also found that after some carbonaceous material and some deposits have built up on one side of the catalytic element facing the exhaust gas inlet, if the element is reoriented so that this side now faces the exhaust gas outlet, at least some of the deposits and carbonaceous material will be blown off of the catalytic element by exhaust gas passing through the catalytic element. Thus, the useful life of the catalytic element is extended.

Other features and advantages of the invention will become apparent to those of ordinary skill in the art upon review of the following detailed description, claims, and drawings.

Figure 1:
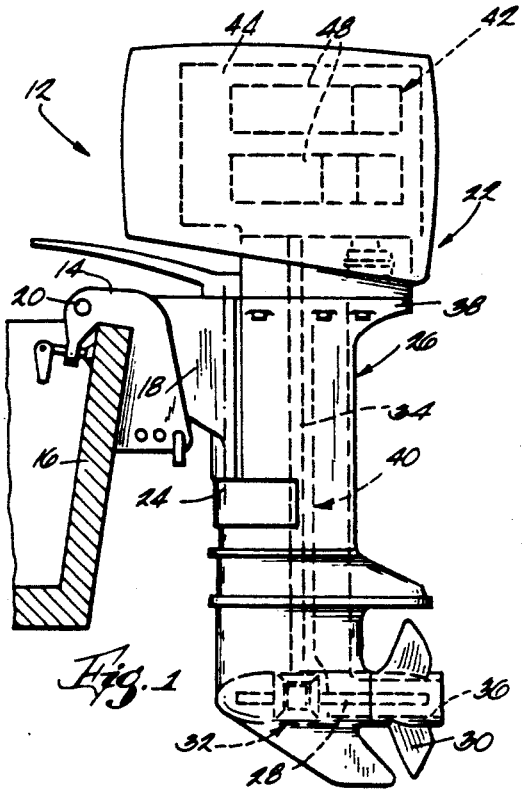
FIG. 1 is a side elevational view of a marine propulsion device which includes a housing, and a catalytic element housed in the housing, and which embodies various of the features of the invention.
Figure 4:
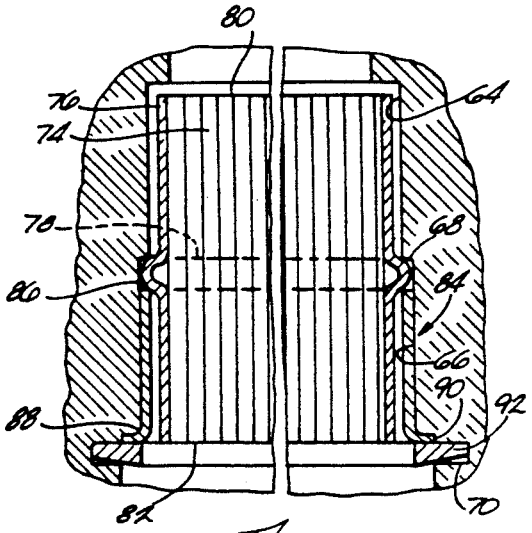
FIG. 4 is an enlarged, broken away, sectional, side elevational view of the marine propulsion device, showing the catalytic element in section, and showing in detail how the catalytic element is housed in the housing.
Figure 3:
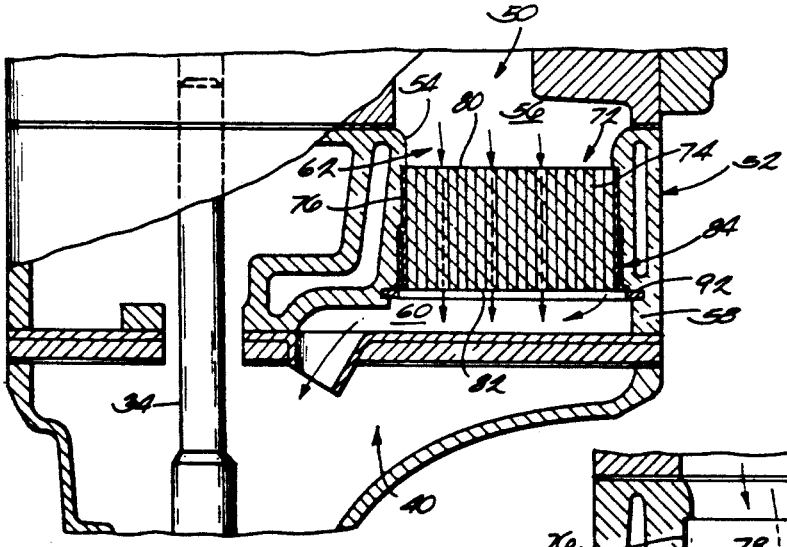
FIG. 3 is a broken away side elevational view of the marine propulsion device, partly in section, and showing the catalytic element in section.
Figure 2:
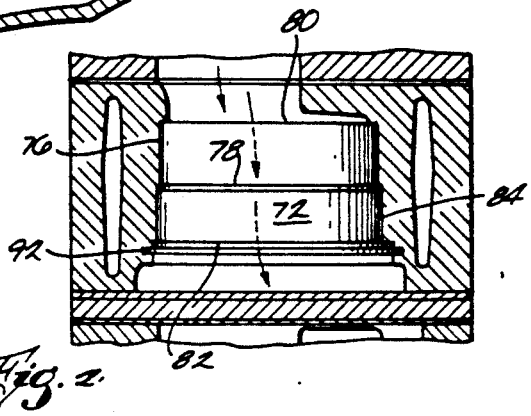
FIG. 2 is a broken away side elevational view of the marine propulsion device, partly in section, and showing the catalytic element not in section.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

A marine propulsion device 12 embodying the invention is illustrated in FIGS. 1–4. While the illustrated marine propulsion device is an outboard motor, the invention is also applicable to other types of marine propulsion devices such as stern drive units.

The marine propulsion device 12 comprises (see FIG. 1) a transom bracket 14 fixedly mounted to a transom 16 of a boat, and a swivel bracket 18 which is mounted on the transom bracket 14 for pivotal movement relative thereto about a generally horizontally extending tilt axis 20.

The marine propulsion device 12 also includes a propulsion unit 22 which is connected to the swivel bracket 18 for common movement therewith about the tilt axis 20 and for pivotal movement relative to the swivel bracket 18 about a generally vertical steering axis 24.

The propulsion unit 22 comprises a lower unit 26. The lower unit 26 includes a propeller shaft 28 supporting a propeller 30, a reversing transmission 32, and a driveshaft 34 drivingly connected to the propeller shaft 28 via the reversing transmission 32. The lower unit 26 further includes an exhaust gas discharge outlet 36 which, in the illustrated embodiment, is of a through-the-propeller type. Alternative exhaust gas discharge outlet locations can also be employed. The lower unit 26 has an upper end 38 and defines an exhaust gas passageway 40 extending from the upper end 38 to the discharge outlet 36.

The propulsion unit 22 further comprises a powerhead 42 bolted or otherwise solidly connected to the upper end 38 of the lower unit 26. The powerhead 42 includes an internal combustion engine 44 drivingly connected to the driveshaft 34. The engine 44 includes an engine block 46 having therein cylinders 48. The lower end of the engine block 46 has therein (see FIG. 3) an exhaust gas outlet 50 communicating with the cylinders 48. The powerhead 42 further comprises an adapter or housing 52 for facilitating mounting of the engine block 46 to the lower unit 26, as is known in the art. Optionally, the adapter 52 is omitted. The adapter 52 has an upper end 54 having therein an exhaust gas inlet 56 communicating with the exhaust gas outlet 50 in the engine block 46, and has a lower end 58 having therein an exhaust gas outlet 60 communicating with the exhaust gas passageway 40 in the lower unit 26, and the adapter defines an exhaust gas passageway 62 extending between the exhaust gas inlet 56 and the exhaust gas outlet 60.

The exhaust gas passageway 62 is defined by (see FIGS. 2–4) a first inner cylindrical surface 64 having a first inner diameter, and a second inner cylindrical surface 66 that is directly below the first inner cylindrical surface 64, that has a second inner diameter greater than the first inner diameter, and that is axially aligned with and adjacent to the first inner cylindrical surface 64. A shoulder 68 is defined between the first inner cylindrical surface 64 and the second inner cylindrical surface 66. The second inner cylindrical surface 66 has a therein a groove 70 for a purpose that will later be explained.

The propulsion unit 22 further includes a generally cylindrically shaped catalytic element 72 supported in the exhaust gas passageway 62. In the illustrated embodiment, the element 72 is housed in the lower end 58 of the adapter 52 so that the element 72 is accessible for servicing when the powerhead 42 is separated from the lower unit 26. If the adapter 52 is omitted, the element 72 can be housed in the lower end of the engine block 46 so that the element 72 is still accessible for servicing when the powerhead 42 is separated from the lower unit 26.

The element 72 comprises catalyst material 74 surrounded by a cylindrical sleeve 76. The sleeve 76 includes a rib 78 and the element has first and second circular ends 80 and 82, respectively. In the illustrated embodiment, the rib 78 extends circumferentially around the sleeve 76 and is located halfway between the first and second ends 80 and 82. The element 72 is selectively housed in the exhaust gas passageway 62 in one of a first orientation, in which the first end 80 of the element 72 faces the exhaust gas inlet 56, and a second orientation, in which the second end 82 of the element 72 faces the exhaust gas inlet 56.

The propulsion unit 22 further includes a retaining sleeve 84, generally in the shape of an open-ended hollow cylinder, having (see FIG. 4) first and second (or upper and lower) ends 86 and 88, respectively. The retaining sleeve 84 is removably mounted in the exhaust gas passageway 62 and partially surrounds the element 72 when the element 72 is housed in the exhaust gas passageway 62. The retaining sleeve 84 has theron a flange 90 extending outwardly from the lower end 88 thereof. When the catalytic element 72 is housed in the exhaust passageway 62 in the first orientation, or the second orientation, the retaining sleeve 84 is mounted in the exhaust gas passageway 62 such that the rib 78 is captured between the shoulder 68 and the end 86 of the retaining sleeve 84.

The propulsion unit 22 further includes an outwardly biased retaining ring 92 selectively received in the groove 70. The retaining ring 92 abuts the flange 90 and thereby retains the retaining sleeve 84 in the exhaust passageway when the element 72 is in the first orientation and when the element 72 is in the second orientation.

The catalytic element 72 is maintained by being periodically reoriented to extend the useful life of the catalyst material 74. Assuming that the element 72 is initially in the first orientation in the exhaust gas passageway 62, the element 72 is reoriented by removing the retaining ring 92 from the exhaust gas passageway 62, removing the retaining sleeve from the exhaust gas passageway 62, removing the element 72 from the exhaust gas passageway 62, reinserting the element 72 into the exhaust gas passageway 62 in the second orientation, reinserting the retaining sleeve in the exhaust gas passageway 62, and reinserting the retaining ring 92 in the exhaust gas passageway 62. The element 72 is similarly reoriented from the second orientation to the first orientation.

Figure 5:
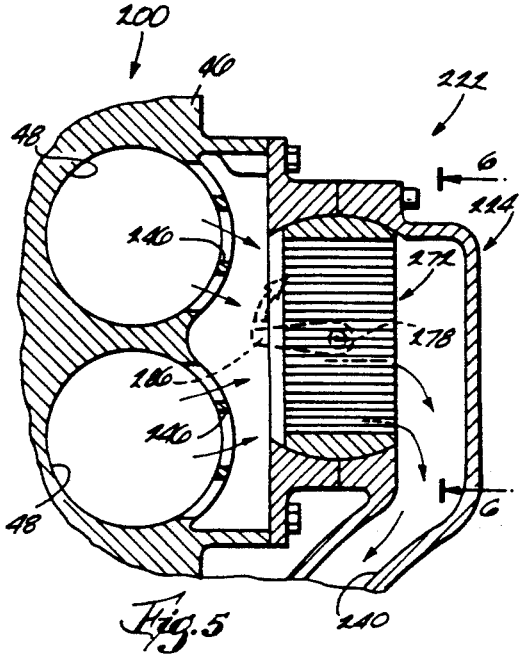
FIG. 5 is a broken away, sectional, rear elevational view of an alternative embodiment of the invention.
Figure 6:
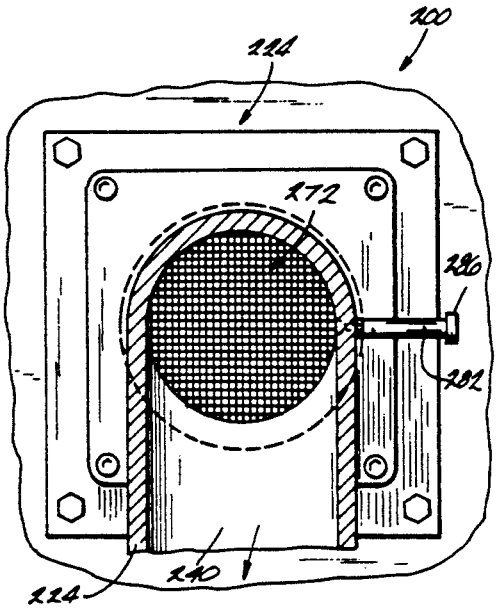
FIG. 6 is a view taken along line 6—6 in FIG. 5.

A marine propulsion device 200 that is an alternative embodiment of the invention is illustrated in FIGS. 5 and 6. Except as described below, the marine propulsion device 200 is substantially identical to the marine propulsion device 12, like reference numerals indicating like components. The marine propulsion device 200 comprises a propulsion unit 222 including an exhaust gas manifold or housing 224 that is bolted or otherwise fixedly attached to the engine block 46, and that defines an exhaust gas passageway 240 communicating between the cylinder exhaust ports 246 and the exhaust gas passageway 40 in the lower unit 26.

The propulsion unit 222 includes a catalytic element 272 located in the exhaust gas passageway 240 and supported by the exhaust gas manifold 224 for reorientation from a first orientation to a second orientation, and includes means for reorienting the element 272 from the first orientation to the second orientation while the element 272 is in the exhaust gas passageway 240. More particularly, in the illustrated embodiment, the reorienting means comprises means exterior of the exhaust gas passageway 240. Still more particularly, the element 272 is pivotally mounted in the exhaust gas passageway 240, and the reorienting means pivots the element 272 about a pivot axis 278. In the illustrated embodiment, the element 272 is pivoted through 180°, from the first orientation to the second orientation, about the pivot axis 278. The propulsion unit 222 further includes a shaft 282 that is connected to the element 272 and that has a portion exterior of the exhaust gas manifold 224. While various other means could be employed, in the illustrated embodiment, the reorienting means comprises a crank handle 286 connected to the shaft 282. The catalytic element 272 is reoriented by turning the crank handle 286 to pivot the element 272 through 180° from the first orientation to the second orientation.

Figure 8:
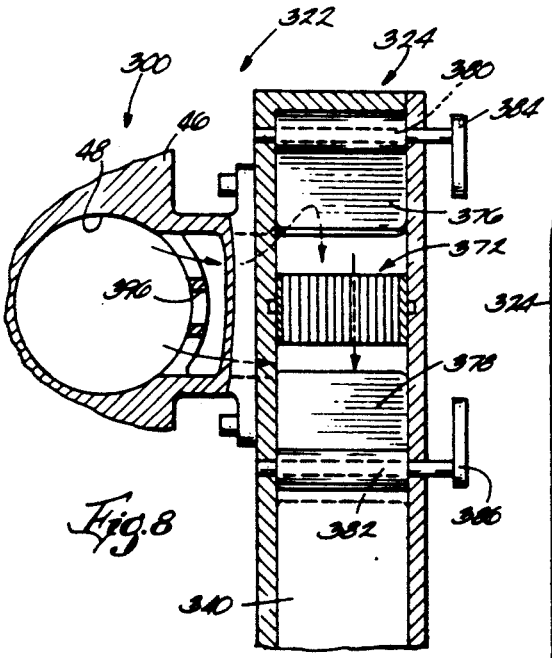
FIG. 8 is a view taken along line 8—8 in FIG. 7.
Figure 7:
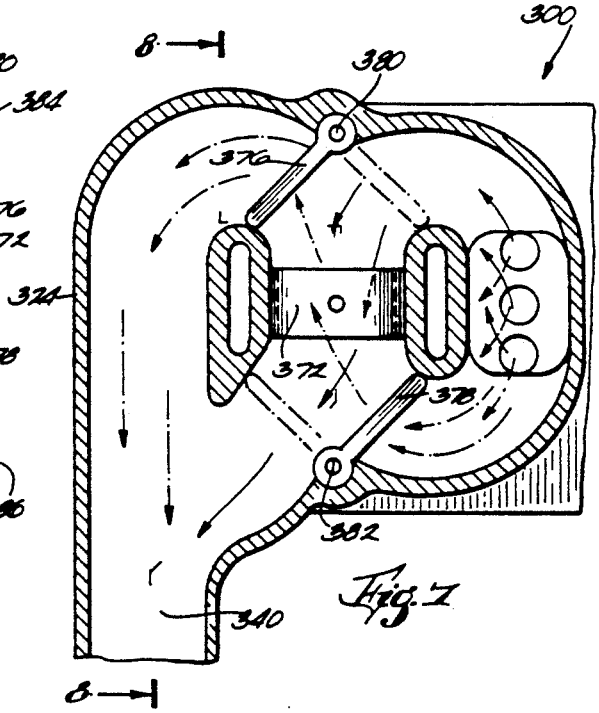
FIG. 7 is a broken away side elevational view of a second alternative embodiment of the invention.

A marine propulsion device 300 that is a second alternative embodiment of the invention is illustrated in FIGS. 7 and 8. Except as described below, the marine propulsion device 300 is substantially identical to the marine propulsion device 12, like reference numerals indicating like components. The marine propulsion device 300 comprises a propulsion unit 322 including an exhaust gas manifold or housing 324 that is bolted or otherwise fixedly attached to the engine block 46, and that defines an exhaust gas passageway 340 communicating between the cylinder exhaust port(s) 396 and the exhaust gas passageway 40 in the lower unit 26. The propulsion unit 322 includes a catalytic element 372 located in the exhaust gas passageway 340 and fixedly supported in the exhaust gas manifold 324. The propulsion unit 322 further includes first and second diverters 376 and 378, respectively, pivotally mounted in the exhaust gas manifold 324. The propulsion unit 322 further includes shafts 380 and 382 that are respectively connected to the diverters 376 and 378, and that include portions extending out of the exhaust gas manifold 324, and crank handles 384 and 386 respectively connected to the shafts 380 and 382 outside the manifold 324. The diverters 376 and 378 and the exhaust gas manifold 324 cooperate to selectively define one of a first exhaust path (shown with solid arrows) , such that exhaust gas flows through the catalytic element in a first direction, and a second exhaust path (shown with dashed arrows), such that exhaust gas flows through the catalytic element in a second direction opposite to the first direction. The diverters 376 and 378 are pivoted by a user, by means of the handles 384 and 386, from their positions shown in FIG. 7 in solid outline, to the positions shown in dashed outline, to change the flow of the exhaust gas from the first direction to the second direction.

Various of the features of the invention are set forth in the following claims.

We claim:

1. A marine propulsion device comprising a propulsion unit including a lower unit supporting a propeller shaft, and a powerhead located above said lower unit and including an engine driving said propeller shaft and including an exhaust port, a housing including an exhaust gas inlet communicating with said exhaust port and an exhaust gas outlet, an element which comprises catalytic material and which is movably supported in said housing about a pivot extending transversely to the direction of flow of exhaust gas through said element for reorientation from a first orientation in said housing to a second orientation in said housing different from the first orientation, and means for reorienting said element from the first orientation to the second orientation.

2. A marine propulsion device in accordance with claim 1 wherein said reorienting means comprises means exterior of said housing, and wherein said reorienting means reorients said element from the first orientation to the second orientation while said element is in said housing.

3. A marine propulsion device in accordance with claim 2 wherein said element is pivotally mounted in said housing, and wherein said reorienting means pivots said element.

4. A marine propulsion device in accordance with claim 3 wherein said element pivots about a pivot axis, and wherein said element is pivoted through 180°, from the first orientation to the second orientation, about the pivot axis.

5. A marine propulsion device in accordance with claim 4 and further comprising a shaft connected to said element and having a portion exterior of said housing, and wherein said reorienting means comprises a crank handle connected to said shaft.

6. A marine propulsion device comprising a propulsion unit including a propeller shaft, a housing having therein an exhaust gas passageway including a shoulder and a wall extending from said shoulder and defining an exhaust gas passageway portion, a catalytic element located in said exhaust gas passageway portion and including a rib, a retaining sleeve which extends in said exhaust gas passageway portion and which partially surrounds said element such that said rib is captured between said shoulder and said retaining sleeve, and means for selectively retaining said retaining sleeve in said passageway portion.

7. A marine propulsion device comprising a propulsion unit including a propeller shaft, a housing including an exhaust gas passageway defined by a first inner cylindrical surface have a first inner diameter, and a second inner cylindrical surface having a second inner diameter which is greater than said first inner diameter, said second inner surface being axially aligned with and adjacent to said first inner cylindrical surface, and a shoulder defined between said first inner cylindrical surface and said second inner cylindrical surface, a catalytic element which is located in said exhaust gas passageway and which is generally cylindrically shaped and includes first and second ends, and a rib located intermediate said ends and extending circumferentially around said element and a retaining sleeve which is generally in the shape of an open-ended hollow cylinder, which is mounted in said housing, and which partially surrounds said element such that said rib is captured between said shoulder and said retaining sleeve.

8. A marine propulsion device in accordance with claim 7 wherein said exhaust gas passageway has an exhaust gas inlet and an exhaust gas outlet, and wherein said element is selectively housed in said exhaust gas passageway in one of a first orientation, in which said first end of said element faces said exhaust gas inlet, and in a second orientation, in which said second end of said element faces said exhaust gas inlet.

9. A marine propulsion device in accordance with claim 8, wherein said second inner cylindrical surface of said housing has therein a groove, wherein said marine propulsion device further comprises an outwardly biased retaining ring removably received in said groove in said housing, and wherein said retaining ring retains said retaining sleeve in said housing when said element is in the first orientation and when said element is in the second orientation.

10. A marine propulsion device in accordance with claim 8 wherein said retaining sleeve has thereon a flange,, and wherein said retaining ring abuts said flange when said element is in the first orientation and when said element is in the second orientation.

11. A method of maintaining an element comprising catalytic material in an engine apparatus including a housing defining an exhaust gas passageway, said method comprising the steps of providing the element in a first orientation in the exhaust gas passageway, and displacing the element about an axis extending transversely to the direction of flow of the exhaust gas through the element to reorientate the element from the first orientation to a second orientation in the exhaust gas passageway different from the first orientation.

12. A method in accordance with claim 11 wherein the element is removably supported in the housing, and wherein said reorienting step comprises the steps of removing the element from the housing, and reinserting the element in the housing in the second orientation.

13. A method in accordance with claim 11 wherein said exhaust gas passageway has an exhaust gas inlet and an exhaust gas outlet, wherein the element has a first end, and a second end, wherein the first end faces the inlet when the element is in the first orientation, and wherein the second end faces the inlet when the element is in the second orientation.

14. A method of maintaining a catalytic element, including a first end, a second end, and a rib having first and second sides, in an engine apparatus including a housing defining an exhaust gas passageway having an exhaust gas inlet, an exhaust gas outlet, and a shoulder between said exhaust gas inlet and said exhaust gas outlet, said method comprising the steps of providing a retaining sleeve, providing the element in a first orientation in the exhaust gas passageway wherein said first end of said element faces said exhaust gas outlet, wherein the retaining sleeve partially surrounds the element, and wherein the rib is captured between the shoulder and the retaining sleeve with the retaining sleeve engaging the first side of the rib, displacing the element to reorientate the element from the first orientation to a second orientation in the exhaust gas passageway wherein said second end of said element faces the exhaust gas outlet, wherein the retaining sleeve partially surrounds the element, and wherein the rib is captured between the shoulder and the retaining sleeve with the retaining sleeve engaging the second side of the rib, said reorienting step comprising the following steps in order: removing the retaining sleeve from the housing, removing the element from the housing, reinserting the element into the housing in the second orientation, and reinserting the retaining sleeve in the housing.

15. A method in accordance with claim 14 wherein the rib is located approximately halfway between the first and second ends of the element.

16. A method in accordance with claim 14 wherein the element is generally cylindrically shaped, wherein the housing includes a inner cylindrical surface, wherein the retaining sleeve is generally in the shape of a hollow open-ended cylinder, wherein said method further comprises the step of providing an outwardly biased retaining ring, wherein the inner cylindrical surface of the housing has therein a groove receiving the retaining ring, wherein the retaining ring retains the retaining sleeve in the housing when the element is in the first orientation and when the element is in the second orientation, and wherein said reorienting step comprises the following steps in order: removing the retaining ring from the housing, removing the retaining sleeve from the housing, removing the element from the housing, reinserting the element into the housing in the second orientation, reinserting the retaining sleeve in the housing, and reinserting the retaining ring in the housing.

17. A method in accordance with claim 16 wherein the retaining sleeve has thereon a flange, and wherein the retaining ring abuts the flange when the element is in the first orientation and when the element is in the second orientation.

18. A method in accordance with claim 11 wherein the element is pivotally mounted in the housing, and wherein said reorienting step comprises the step of pivoting the element.

19. A method in accordance with claim 18 wherein the element pivots about a pivot axis, and wherein the element is pivoted through 180°, from the first orientation to the second orientation, about the pivot axis.

20. A method of maintaining a catalytic element in an engine apparatus including a housing defining an exhaust gas passageway, wherein the catalytic element, the engine apparatus and the housing defining the exhaust gas passageway partially define a propulsion unit of a marine propulsion device, wherein the propulsion unit includes a powerhead comprising the engine apparatus, wherein the powerhead has a bottom portion wherein the element is supported, wherein the propulsion unit further includes a lower unit including a propeller shaft and a driveshaft drivingly connected between the engine apparatus and the propeller shaft, and wherein the lower unit is separably connected to the bottom portion of the powerhead, said method comprising the steps of providing the element in a first orientation in the exhaust gas passageway, separating the lower unit from the powerhead, and displacing the element to reorientate the element from the first orientation to a second orientation in the exhaust gas passageway different from the first orientation.

* * * * *